United States Patent [19]

Kublan

[11] 4,244,136

[45] Jan. 13, 1981

[54] SUSPENDING AND PROPELLING MEANS FOR TOY FIGURES

[75] Inventor: Neal Kublan, Brookville, N.Y.

[73] Assignee: Mego Corp., New York, N.Y.

[21] Appl. No.: 95,581

[22] Filed: Nov. 19, 1979

[51] Int. Cl.[3] ..... A63H 3/50

[52] U.S. Cl. ..... 46/32; 46/1 H; 248/331; 272/24

[58] Field of Search ..... 46/1 R, 77, 32, 1 H, 46/116; 254/188, 169; 273/413; 272/24; 104/180, 173 R, 112; 248/328, 329, 331

[56] References Cited

U.S. PATENT DOCUMENTS

| | | | |
|---|---|---|---|
| 613,098 | 10/1898 | Vought | 248/331 |
| 1,615,986 | 2/1927 | Knight | 46/77 |
| 1,895,721 | 1/1933 | Mayo | 272/24 UX |
| 2,177,709 | 10/1939 | Gibbons | 46/77 |
| 2,634,127 | 4/1953 | Shapiro | 46/77 X |
| 3,864,868 | 2/1975 | Wolf | 46/1 H |

*Primary Examiner*—Gene Mancene
*Assistant Examiner*—Mickey Yu
*Attorney, Agent, or Firm*—Bertram Frank

[57] ABSTRACT

A suspending and propelling means is provided to impart a "flying" action to toy figures, wherein a support clip, with means for quick attachment and detachment with respect to the back or other body part of a toy figure, is suspended on two lengths of a continuous strand extending between fixed and movable pulley members, one end of said strand being secured to the fixed pulley member, and the other end of said strand being movable with respect to said fixed pulley member and secured to one end of said support clip. From a starting position in which the supported figure is adjacent the movable pulley member, pulling on the latter causes the toy figure to "fly" toward the fixed pulley member.

11 Claims, 7 Drawing Figures

SUSPENDING AND PROPELLING MEANS FOR TOY FIGURES

This invention relates to a suspending and propelling means to impart a "flying" action to toy figures, wherein a support clip, with means for quick attachment and detachment with respect to the back or other body part of a toy figure, is suspended on two lengths of a continuous strand extending between fixed and movable pulley members, one end of said strand being secured to the fixed pulley member, and the other end of said strand being movable with respect to said fixed pulley member and secured to one end of said support clip. From a starting position in which the supported figure is adjacent the movable pulley member, pulling on the latter causes the toy figure to "fly" toward the fixed pulley member.

The broad concept of suspending and propelling toy objects between a starting or control location and a somewhat distant and elevated position is not new. U.S. Pat. Nos. 1,676,989 and 3,893,256, for example, show such simulated "flying" action wherein propulsion is achieved by the spreading of a pair of strand members passing through guide means on the supported object. These approaches have the disadvantage of requiring two hands to properly control the "flying" object, and the guide means facilitating the control constitutes an integral part of the "flying" object.

The novel approach in accordance with the present invention is considered distinctly superior in requiring the use of only one hand to manipulate and control the "flying" object. Furthermore, the provision of quick and easy means for attaching the support clip to different objects, or parts thereof, inherently adds interest for the juvenile user.

Regarded in certain of its broader aspects, the novel suspending and propelling means for imparting a "flying" action to toy figures and objects comprises a support clip disposed between fixed and movable pulley members, said support clip being a generally rectangular member with upstanding ends having aligned apertures adjacent the side extremities thereof, one of said upstanding ends having a central strand coupling means, and said support clip and pulley members being united by an elongated flexible strand, said flexible strand having one end secured to said clip at said central strand coupling means, and passing through said fixed pulley member, then through the aligned apertures at one side of said clip and through the movable pulley member, then back through the aligned apertures at the other side of said clip and to the fixed pivot member to which the other end of said strand is secured, and the length of said strand being such that when the support clip is adjacent the movable pulley member, and under slight tension, the distance between the support clip and fixed pulley member will be in excess of about three feet, whereby grasping and pulling on said movable pulley member causes a toy figure or object secured to said support clip to be suspended, and moved toward said fixed pulley member.

The flexible strand should be as fine as possible, consistent with the weight of the toy figures or objects to be used. Woven fishing lines of appropriate size are effective and durable, and the monofilament, plastic fishing lines are particularly desirable as providing almost invisible support for the suspended object.

The length of the flexible strand can be varied widely depending on the "flying" distance desired for the suspended toy figure or object, the limiting factor being the space which must be allowed for movement of the movable pulley member, which is approximately one-half of the "flying" distance.

The support clip and pulley member can be formed wholly of molded plastic, particularly when intended for use with light-weight toy figures or objects. In such instances, the pulley action is achieved by the flexible strand sliding around transverse plastic rods. In a more heavy duty form of device, the transverse rods may be metal, and may support rotatable pulley members. Similarly, in the support clip, the strand guide apertures in a heavy duty adaptation may be reinforced with metal eyelet.

Attachment of the toy figure or object to the support clip is accomplished by a rubber band or other elastic loop member of appropriate size; and to provide flexibility in use, the device is preferably supplied with a plurality of different size elastic loops.

The suspending and propelling means of the present invention will be more fully understood from a consideration of the following description, having reference to the accompanying drawing in which preferred adaptations have been illustrated, with various parts thereof identified by suitable reference characters in each of the views , and in which.

Figure 1:
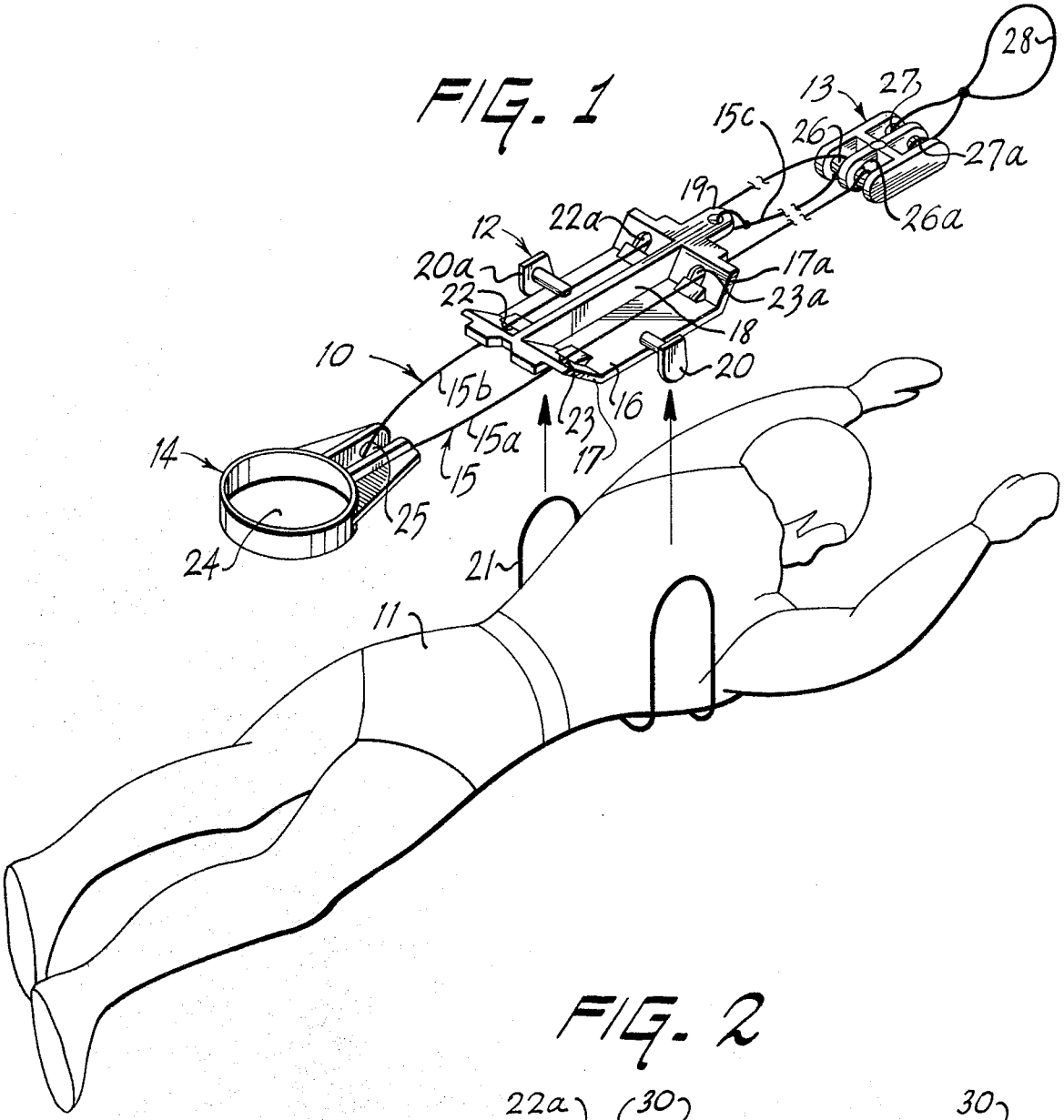
FIG. 1 is a perspective view of one form of suspending and propelling means in accordance with the invention, shown in exploded relation to a toy figure to be supported, and with support clip and pulley components operatively joined by a flexible strand.

As shown in FIG. 1 of the drawing, the suspending and propelling means 10 for imparting "flying" action to a toy figure 11 comprises a support clip 12, a fixed pulley member 13 and a movable pulley member 14 which are united by flexible strand 15 which is interlaced therewith in the manner shown and hereinafter described.

The support clip 12 comprises a generally rectangular base plate 16 integrally joined to upstanding ends 17, **17*a* and having a central stiffening rib 18. Externally of one end 17*a*, and in alignment with rib 18, is a loop 19 for anchoring strand 15 to the support clip. Centrally of opposed sides of base plate 18 are laterally and upwardly extending hooks 20, 20*a* receiving loops of an elastic band 21 which is of appropriate size to firmly support the clip 12 on the figure or other object 11**.

Adjacent the extremities of ends 17, **17*a* are aligned apertures 22, 22*a* and 23, 23*a* for slidably receiving strand 15 in two passes 15*a*, 15*b* through support clip 12. It is on these two passes 15*a*, 15*b* of strand 15 that support clip 12 moves, and the relatively wide transverse spacing of apertures 22, 23 and 22***a*, 23*a* provides stability for the supported figure or object 11 as is is suspended and moves.

Movable pulley member 14 is a ring-like body having an enlarged, finger engaging aperture 24 at one side and a transverse shaft or spindle 25 around which strand 15 passes. Fixed pulley member 13 is a slightly elongated block with four spaced openings providing pairs of transverse shafts or spindles 26, 26*a* and 27, 27*a*. One set of spindles, 27, 27*a* as shown in the drawing, support a small flexible loop 28 suitable for attachment to a doorknob, wall hook, chair post, or other elevated fixed support. The other pair of spindles 26, 26*a* engage the strand 15 in the manner shown and hereinafter described.

An appropriate length of strand 15, suitably in excess of about 15 feet, is assembled to the components above described by fastening one end to loop 19 of the support clip 12, passing the strand 15 around spindle 26 of fixed pulley member 13, then through aperture 22*a* and 22 of support clip 12, around spindle 25 of movable pulley member 14, then through apertures 23 and 23*a* of support clip 12 to spindle 26*a* of fixed pulley member 13 where the free end of strand 15 is anchored.

With a strand 15 which is 16 feet long, and with the movable pulley member 14 close to the support clip 12 as shown in FIG. 1, the spacing between support clip 12 and fixed pulley member 13 is approximately five feet. This is practical for a young childs use as the five foot movement of the support clip 12 and figure or object 11 mounted thereon can stimulate active interest, and this movement is obtained by pulling on movable pulley member 14 in the direction of arrow 29 through a distance of about two and one-half feet. Even with a small child, this, with a little practice, can be accomplished by arm movement alone. It will be apparent that the older and more imaginative child may insert a strand 15 of any desired length to extend the "flight path" of the supported object 11 to eight feet, ten feet or more, while making proper allowance for the fact that movable pulley member 14 must be moved a distance equal to about one-half the "flight path."

The strand 15 should be strong and highly flexible, with preferred strand material being fishing line of the braided type or the monofilament type. The monofilament type in clear plastic has the special advantage of being almost invisible, thus adding to the illusion of "free flying" of the supported figure in object 11.

Figure 2:
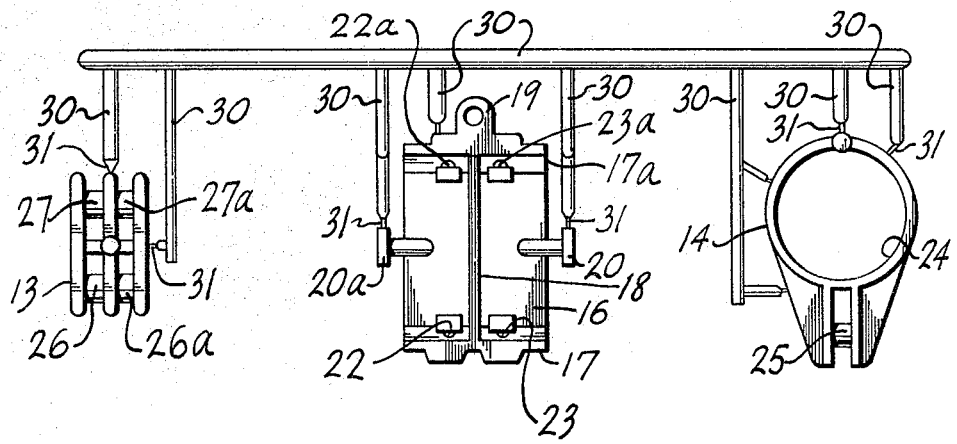
FIG. 2 is a plan view of the components shown in FIG. 1 in their original molded configuration, with gates attached, such configuration being maintained during storage and handling prior to initial use.

As above described the components 12, 13 and 14 can be formed completely of molded plastic, in which event they can be molded collectively and held together by gate portions 30 of the molded mass as shown in FIG. 2. The gate portions 30 are of small dimension adjacent the molded components, as is conventional in the plastic molding art, to permit easy separation of the molded components when desired. For ease of handling, packaging and use by the customer, it is advantageous to treat the component-gate assemblage shown in FIG. 2 as the form in which the device is marketed, the same being packaged with appropriate loop 28, strand 15, one or more elastic bands 21 and instructions for making the assemblage as shown in FIG. 1.

When a more rugged construction is desired, as when the device is to be used with relatively heavy figure or object 11, it may be desirable to supplement basically molded components with metal parts at critical points as shown in components 12', 13' and 14' of FIGS. 3 to 7. When applicable in FIGS. 3 to 7, details of structure have been identified with the prime (') form of the reference characters used in FIGS. 1 and 2.

Figure 3:
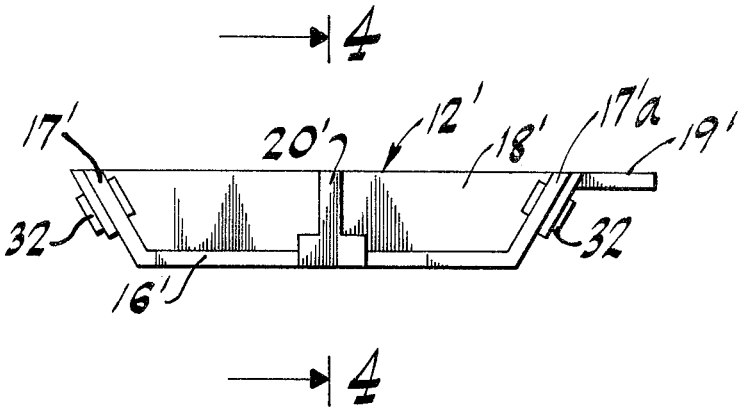
FIG. 3 is a side elevation view of a modified form of support clip.
Figure 4:
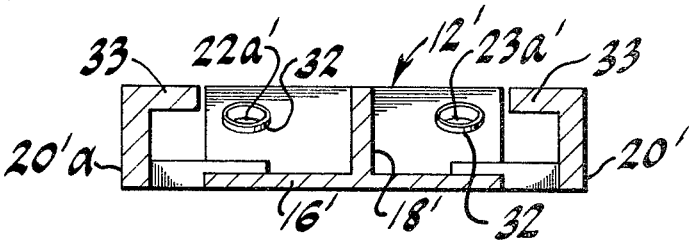
FIG. 4 is a sectional view taken substantially on the line 4—4 of FIG. 3.

As shown in FIGS. 3 and 4, the apertures 22*a'*, 23*a'*, etc. in end walls 17', 17*a'* of support clip 12' have been reinforced with metal eyelets 32. In addition, the hooks 20', 20*a'* have been provided with inwardly extending top flanges 33 for more positive interlock with elastic band 21 which encircles the supported figure on object 11.

Figure 5:
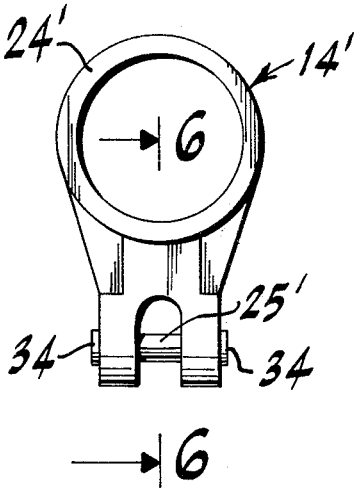
FIG. 5 is a plan view of a modified form of movable pulley member.
Figure 6:
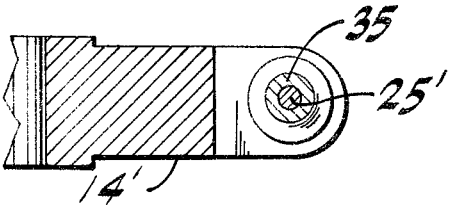
FIG. 6 is a sectional view substantially on the line 6—6 of FIG. 5, and showing a further modification.

As shown in FIG. 5, the movable pulley member 14', at the end opposed to the finger loop 24' is provided with a separate metal spindle 25' passing through the part and anchored by suitable means such as the enlarged ends 34. The sectional view in FIG. 6 shows the metal spindle 25' as carrying a pulley 35 around which strand 15 will pass. In most instances, however, the use of an actual pulley 35 is not warranted as suitable "pulley action" is achieved with the strand 15 sliding around the spindle 25 or 25'.

Figure 7:
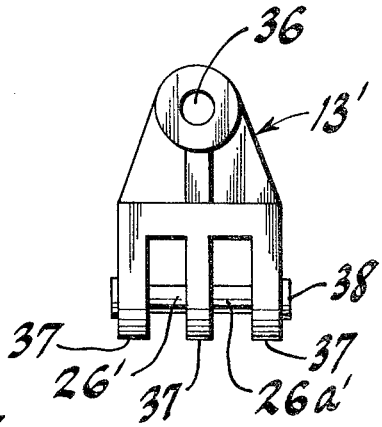
FIG. 7 is a plan view of a modified form of fixed pulley member.

In FIG. 7 of the drawing, the fixed pulley member 13' has been shown as having a tapered contour with an aperture 36 in the narrow end for attaching a loop 28 to be engaged with a fixed support. The wide end has three projections 37 through which pass a metal spindle 38, thereby providing spindle portions 26' and 26*a'* serving the purpose described in FIG. 1. If desired, the spindle portions 26' and 26*a'* can each carry a pulley similar to the pulley 35 shown in FIG. 6.

Various changes and modifications in the suspending and propelling means herein disclosed may occur to those skilled in the art, and to the extent that such changes and modifications are embraced by the appended claims, it is to be understood that they constitute part of the present invention.

What is claimed is:

1. A suspending and propelling means for imparting a "flying" action to toy figures and objects comprising a support clip disposed between fixed and movable pulley members, said support clip being a generally rectangular member with upstanding ends having aligned apertures adjacent the side extremities thereof, one of said upstanding ends having a central strand coupling means, and said support clip and pulley members being united by an elongated flexible strand, said flexible strand having one end secured to said clip at said central strand coupling means, and passing through said fixed pulley member, then through the aligned apertures at one side of said clip and through the movable pulley member, then back through the aligned apertures at the other side of said clip and to the fixed pulley member to which the other end of said strand is secured, and the length of said strand being such that when the support clip is adjacent the movable pulley members, and under slight tension, the distance between the support clip and fixed pulley member will be in excess of about three feet, whereby grasping and pulling on said movable pulley member causes a toy figure or object secured to said support clip to be suspended, and moved toward said fixed pulley member.

2. A suspending and propelling means, as defined in claim 1, wherein said support clip has upwardly extending hooks, centrally of opposed sides thereof, said hooks cooperating with looped ends of an encircling elastic band in securing a toy figure or object to said support clip.

3. A suspending and propelling means as defined in claim 2, wherein said hooks have inwardly turned upper ends.

4. A suspending and propelling means as defined in claim 1, wherein said support clip and pulley members are formed wholly of molded plastic material.

5. A suspending and propelling means as defined in claim 4, wherein the assemblage of said support clip and pulley members, united by the gate means formed in the molding thereof, constitutes a practical article of commerce.

6. A suspending and propelling means as defined in claim 1, wherein said support clip and pulley members are formed primarily of molded plastic but have metal supplements at wear portions thereof.

7. A suspending and propelling means as defined in claim 6, wherein said metal supplements include eyelets seated in the aligned apertures of said support clip.

8. A suspending and propelling means as defined in claim 6, wherein said metal supplements include transverse spindles providing strand engaging portions of said pulley members.

9. A suspending and propelling means as defined in claim 8, wherein said spindles carry rotatable pulleys facilitating movement of said strand members through said pulley members.

10. A suspending and propelling means as defined in claim 1, wherein said strand member has the strength and flexibility characteristic of fishing line.

11. A suspending and propelling means as defined in claim 10, wherein said strand member is of the plastic and monofilament type.

* * * * *